US006957616B1

(12) United States Patent
Chang

(10) Patent No.: US 6,957,616 B1
(45) Date of Patent: Oct. 25, 2005

(54) RESTORING DEVICE OF TENSION ADJUSTING DEVICE FOR SEWING MACHINES

(76) Inventor: Tseng Hsien Chang, 9F, No. 270, Gaogong Rd., South District, Taichung City 402 (TW)

( * ) Notice: Subject to any disclaimer, the term of this patent is extended or adjusted under 35 U.S.C. 154(b) by 0 days.

(21) Appl. No.: 11/004,945

(22) Filed: Dec. 7, 2004

(51) Int. Cl.[7] ..... D05B 47/02
(52) U.S. Cl. ..... 112/254
(58) Field of Search ..... 112/254, 255, 302; 242/147 R, 149, 153

(56) References Cited

U.S. PATENT DOCUMENTS 4,300,464 A * 11/1981 Bonalumi ..... 112/254
4,726,308 A * 2/1988 Aida et al. ..... 112/254
4,803,936 A * 2/1989 Mikuni et al. ..... 112/254
5,265,548 A * 11/1993 Satoma ..... 112/254
6,843,189 B2 * 1/2005 Chang ..... 112/254

* cited by examiner

*Primary Examiner*—Ismael Izaguirre
(74) *Attorney, Agent, or Firm*—Rosenberg, Klein & Lee

(57) ABSTRACT

A restoring device of a tension adjusting device in a transverse arm for a sewing machine includes a main part which has an active member and a passive member on two sides thereof so as to drive two sides of a pressing board of the control set. When the user adjusts the adjusting knob, the control set of the tension adjusting mechanism can be adjusted by the movement of the pressing board so as to prolong the life of use of the control set.

10 Claims, 8 Drawing Sheets

RESTORING DEVICE OF TENSION ADJUSTING DEVICE FOR SEWING MACHINES

FIELD OF THE INVENTION

The present invention relates to a restoring device of tension adjusting device for sewing machines and two ends of each control set are controlled by an active member of the main part so as to restore the tension adjusting mechanism evenly.

BACKGROUND OF THE INVENTION

A conventional tension adjusting device generally includes multiple sets of adjusting units which are required to be restored precisely. However, there are some inherent problems which are not overcome by the existed tension adjusting device.

The present invention intends to provide a restoring device of the tension adjusting device of sewing machines, and the restoring device includes a restoring arm and a restoring member on two sides of the main part and the two restoring arm and member apply forces on the pressing board which evenly applies to the restoring sets so as to achieve the desired functions.

SUMMARY OF THE INVENTION

The present invention relates to a restoring device of a tension adjusting device in a transverse arm for a sewing machine. The tension adjusting device comprises a main part with a plurality of tension adjusting frames, micro-adjusting sets and restoring sets connected thereto so as to form a tension adjusting mechanism. The restoring sets are controlled by a control set on the main part which has an active member which driven by an adjusting knob and the active member drives a control shaft on the main part. The control set has a pressing board which is pivotably connected to the main part so as to press and control the restoring set. The control shaft has a driving member connected thereto and the pressing board is driven by the active member and the driving member.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
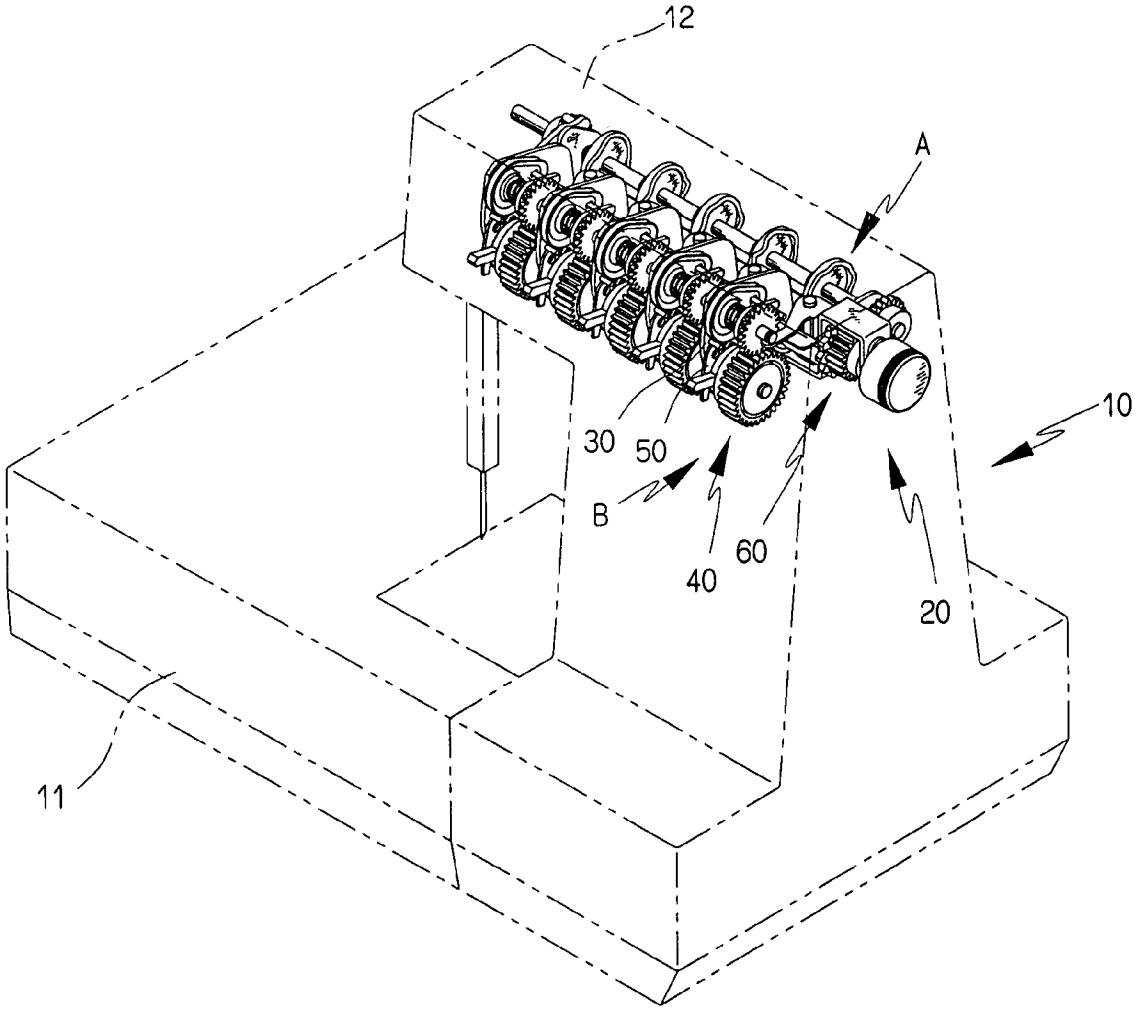
FIG. 1 shows the sewing machine with the restoring device of the present invention.
Figure 2:
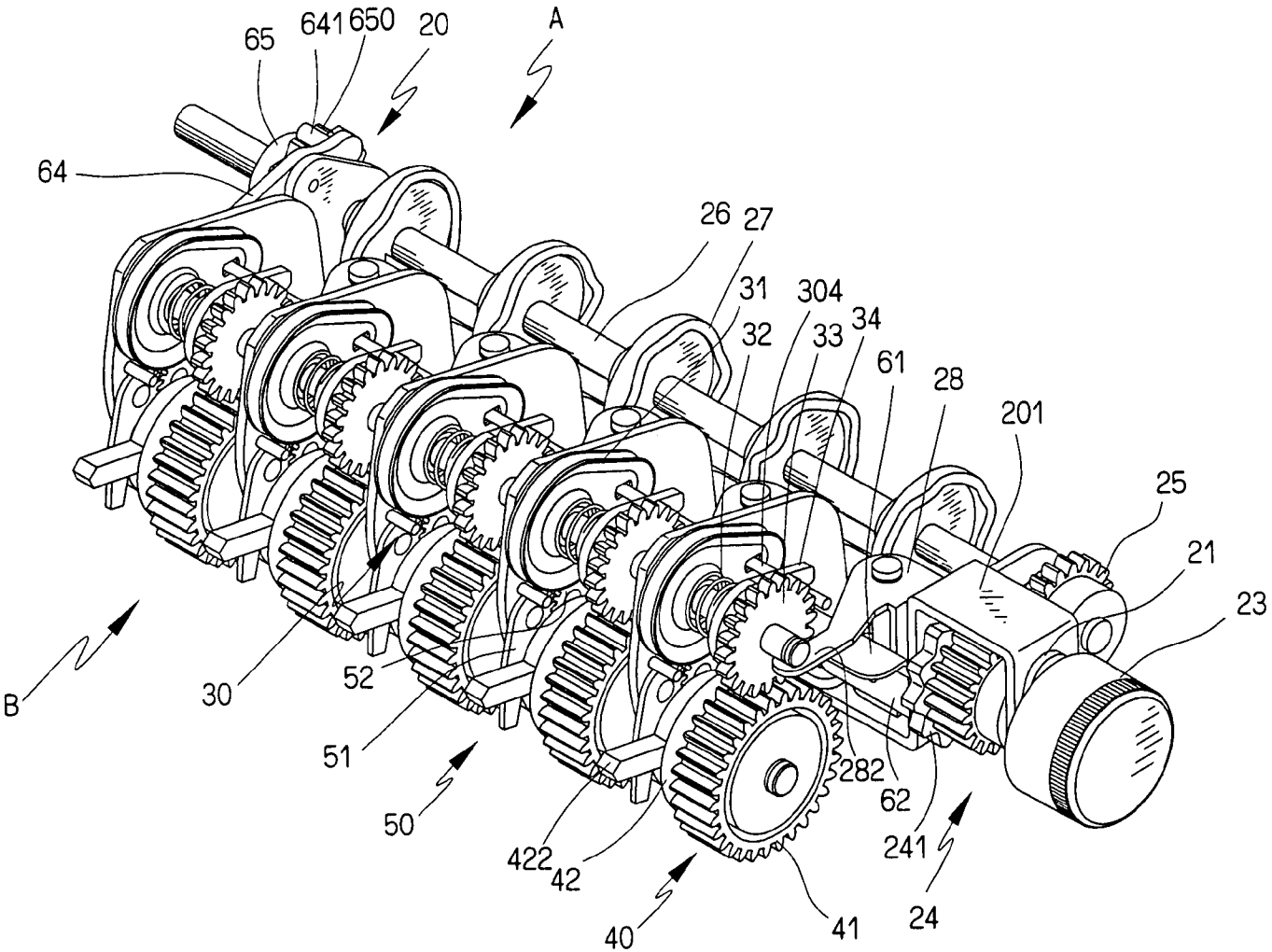
FIG. 2 shows the tension adjusting mechanism of the present invention.
Figure 3:
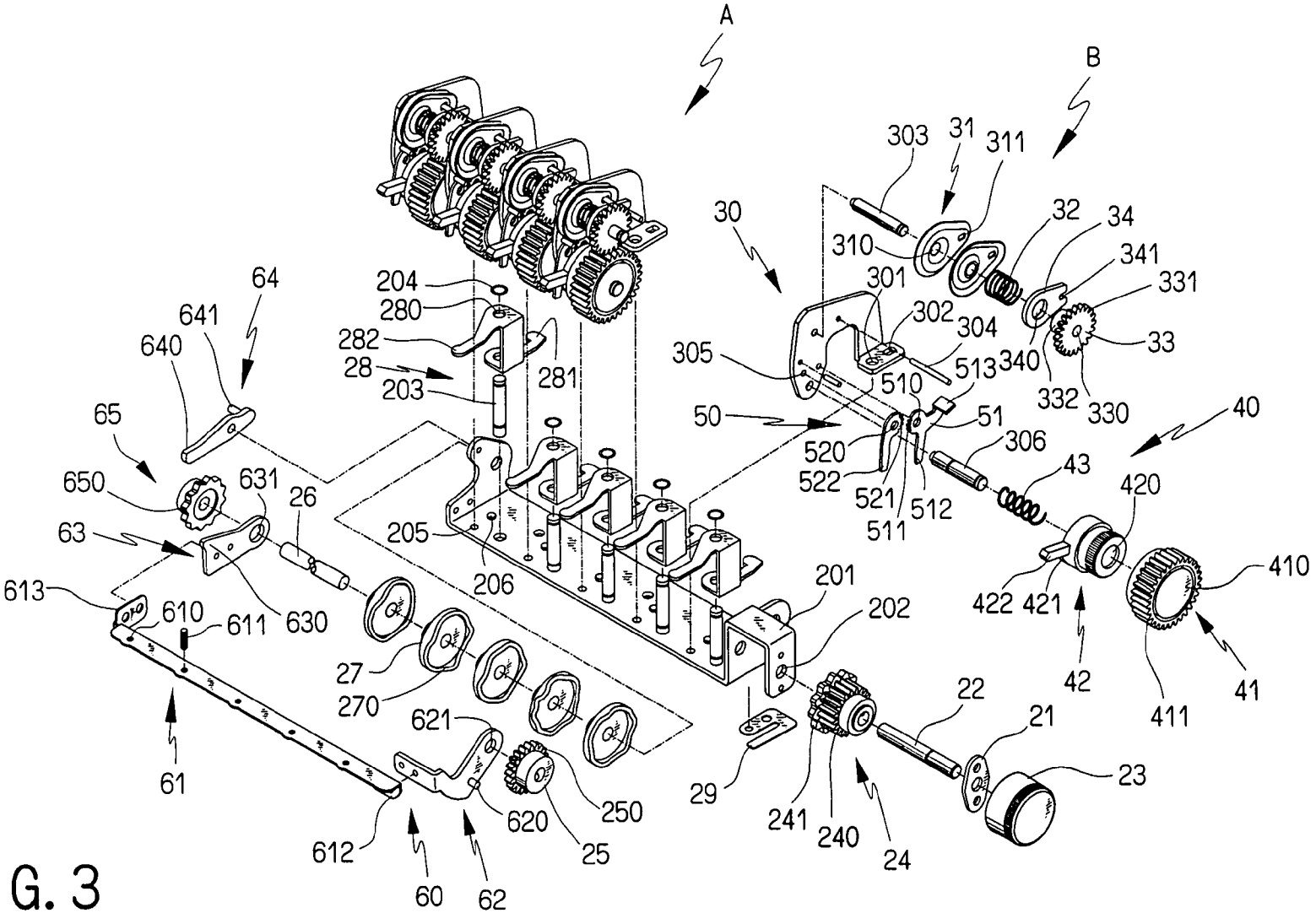
FIG. 3 is an exploded view to show the tension adjusting mechanism of the present invention.

Referring to FIGS. 1 to 4, a tension adjusting device "A" is received in a transverse arm 12 of a sewing machine 10 and the tension adjusting device "A" comprises a main part 20 with a plurality of tension adjusting frames 30, micro-adjusting sets 40 and restoring sets 50 connected thereto so as to form a tension adjusting mechanism "B". Each of the tension adjusting frames 30 has a micro-adjusting set 40 connected thereto. Each micro-adjusting set 40 includes a restoring set 50 which is controlled by a control set 60 on the main part 20. The control set 60 has a restoring control part on each of the two ends thereof so as to apply a force on the pressing board 61.

The main part 20 has a bracket 201 at one end thereof and two holes 202 are defined through two ends of the bracket 201. A retainer 21 is threadedly connected to the bracket 201 such that a second control shaft 22 extends through the bracket 201 and a hole in the retainer 21. An active member 24 is mounted to the second control shaft 22 and an end of the second control shaft 22 extends beyond the transverse arm 12 so as to be connected to a control shaft 26.

Five control wheels 27 are mounted to the control shaft 26 and each have a plurality of travel control portions 270. A passive member 25 is connected to the end of the control shaft 26 that extends through the bracket 201 by a C-shaped clip. Five pins 203 are connected to the main part 20 and a control arm 28 mounted to each of the pins 203. The control arm 28 includes a contact end 282 at one end thereof and the other end of the control arm 28 has a pushing end 281. The contact end 282 is located close to the tension adjusting frame 30 and the pushing end 281 is engaged with the travel control portion 270 of the control wheel 27.

The tension adjusting mechanism "B" further has a threaded hole 205 and a positioning rod 206 located beside the pin 203 corresponding thereto. An active wheel 240 is connected to the active member 24 and engaged with the passive wheel 250 of the passive member 25. The other end of the control shaft 26 extends through the main part 20 and is connected to a driving member 65. A restoring disk 241 is connected to an outer periphery of the active member 24.

The tension adjusting frame 30 has a main shaft 303, a stop pin 304 and a micro-adjusting shaft 306 which is connected to a micro-adjusting set 40. A tension plate 31, a spring 32, an end plate 34 and an adjusting gear 33 are respectively mounted to the main shaft 303. Two holes 305 are defined through the tension adjusting frame 30 so that the restoring sets 50 can be positioned. The micro-adjusting set 40 has a micro-adjusting member 41 which is engaged with the adjusting gear 33. The micro-adjusting member 41 has a correction member 42 at a center thereof and the correction member 42 has correction rods 422 and restoring rod 421. The stop pin 304 keeps the tension plate 31 and the end plate 34 to be stationary. The spring 32 is biased between the end plate 34 and the tension plate 31.

The restoring set 50 has a restoring active pawl 51 and a restoring passive pawl 52 which is engaged with the restoring active pawl 51. Each of the restoring active pawl 51 and the restoring passive pawl 52 has a restoring end 512/522 so that the restoring set 50 may clamp the restoring rod 421. The restoring active pawl 51 has an action end 513 which extends toward the main part 20 and is located opposite to a pressing board 61 of a control set 60.

Two ends of the pressing board 61 of the control set 60 are connected to a restoring arm 62 and a pushing end 630 extending from the extension portion 63 of the control set 60. Two respective free ends of the restoring arm 62 and the extension portion 63 are connected to the control shaft 26. A restoring member 64 is located above the extension portion 63 which has an end in contact with an end of the restoring member 64, the other end of the restoring member 64 has a rod 641. The control shaft 26 has an end which extends through the main part 20 and a driving member 65 is connected to the end of the control shaft 26. The main part 20 has an end piece 29 which is in contact with the restoring arm 62. The restoring arm 62 has a rod 620 so as to be engaged with the driving member 65. The passive wheel 250 is engaged with the rod 620 on the restoring arm 62 and the rod 641 on the restoring member 64. The pressing board 61 has an adjusting hole 610 defined therethrough which is located corresponding to the action end 513 of the restoring active pawl 51 so that an adjusting bolt 611 extends through the adjusting hole 610 and contacts the action end 513.

The control arm 28 includes a contact end 282 at one end thereof and the other end of the control arm 28 has a pushing end 281, the contact end 282 is located close to the tension adjusting frame 30 and the pushing end 281 is engaged with the travel control portion 270 of the control wheel 27.

Figure 4:
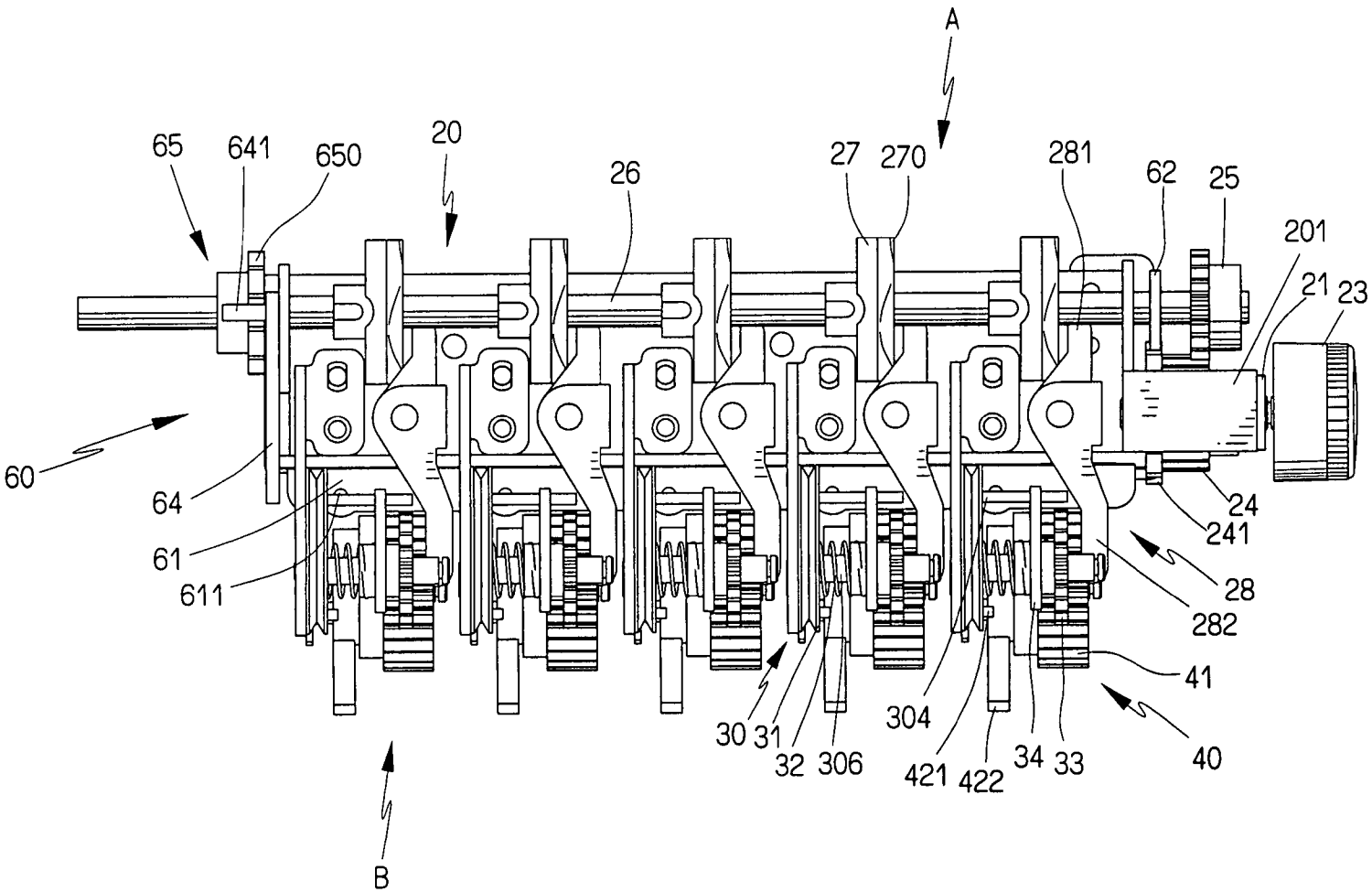
FIG. 4 shows a top view of the tension adjusting mechanism of the present invention.
Figure 5:
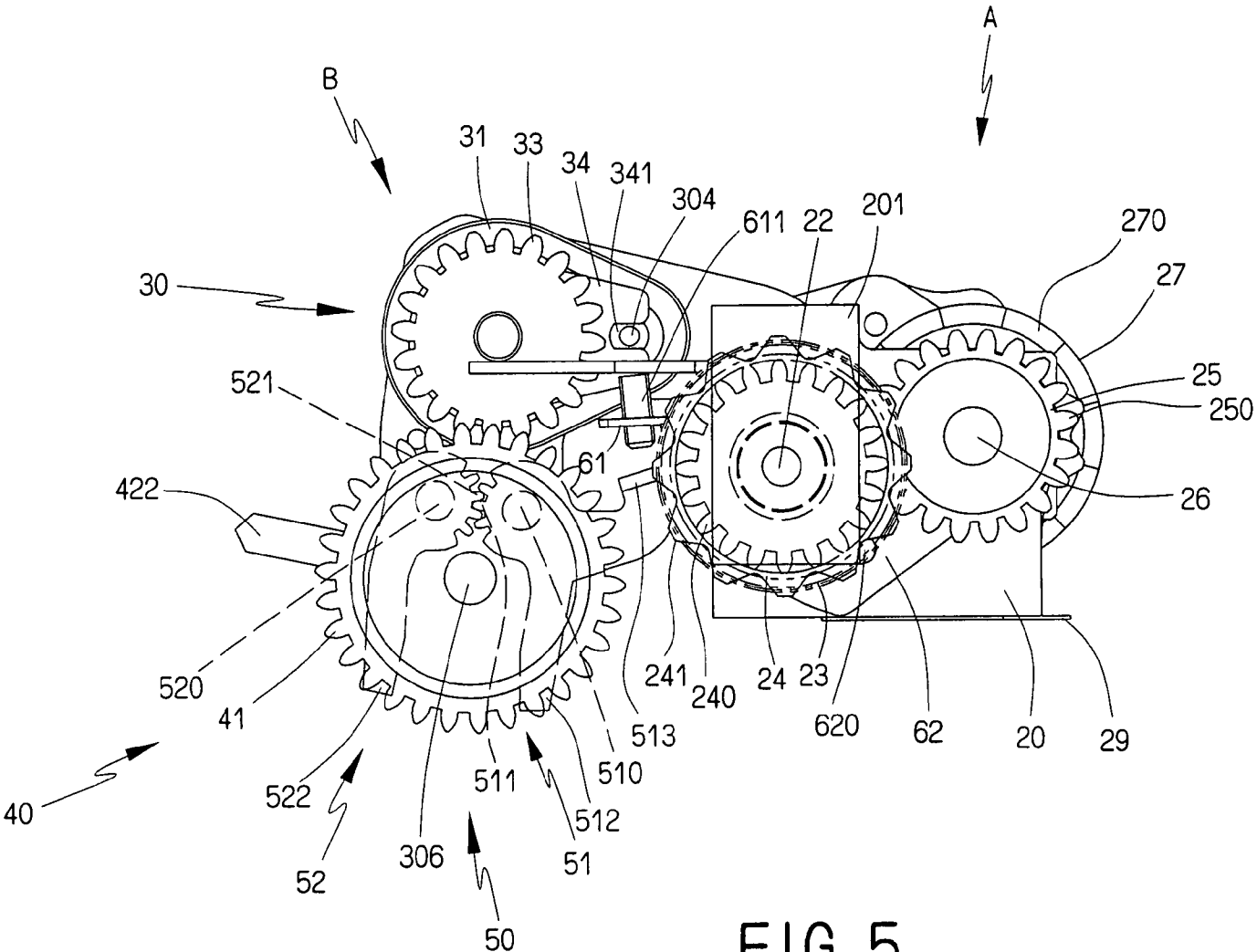
FIG. 5 shows a right side view of the tension adjusting mechanism of the present invention.
Figure 6:
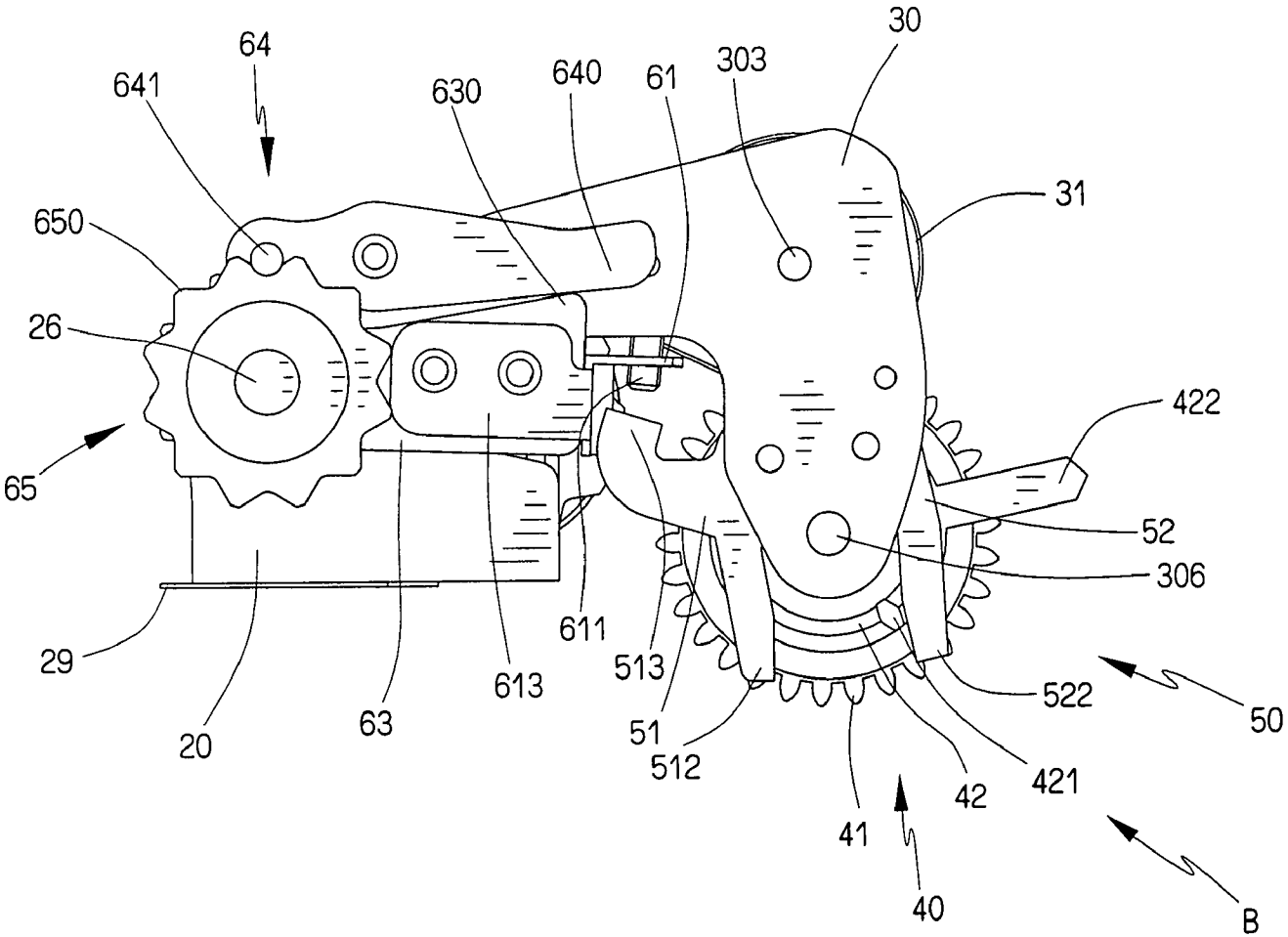
FIG. 6 shows a left side view of the tension adjusting mechanism of the present invention.

As shown in FIGS. 4 to 6, when restoring the sewing machine 10, it is regardless to the positions of the restoring rods 421 of the micro-adjusting sets 40, when the adjusting knob 23 is rotated, the restoring arm 62 is driven by the rod 620 of the control set 60 which is activated by the restoring disk 241, the restoring arm 62 applies a force on the pressing board 61. The restoring arm 62 moves back to its initial position by the end piece 29. The restoring disk 241 is driven by the active member 24 and the passive member 25, and activates the driving member 65 on the other end of the control shaft 26. The driving member 65 drives the rod 641, the function end 640 and the pushing end 630 to apply a force to the connection boards 613. The pressing board 61 is applied by two respective forces from the connection boards 613 at two ends of the pressing board 61 so as to evenly press the action end 513 of the restoring active pawl 51 and drives the restoring passive pawl 52 so that both of the restoring active pawl 51 and drives the restoring passive pawl 52 are pivoted and the restoring ends 512, 522 move toward the initial positions simultaneously. The restoring rod 421 is then pushed to its original position. When the adjusting knob 23 is adjusted to another tension scale, the restoring disk 241 slips over one tooth, the restoring rod 421 is not clamped and able to move within a range of the active pawl 51 and the passive pawl 52.

Figure 7:
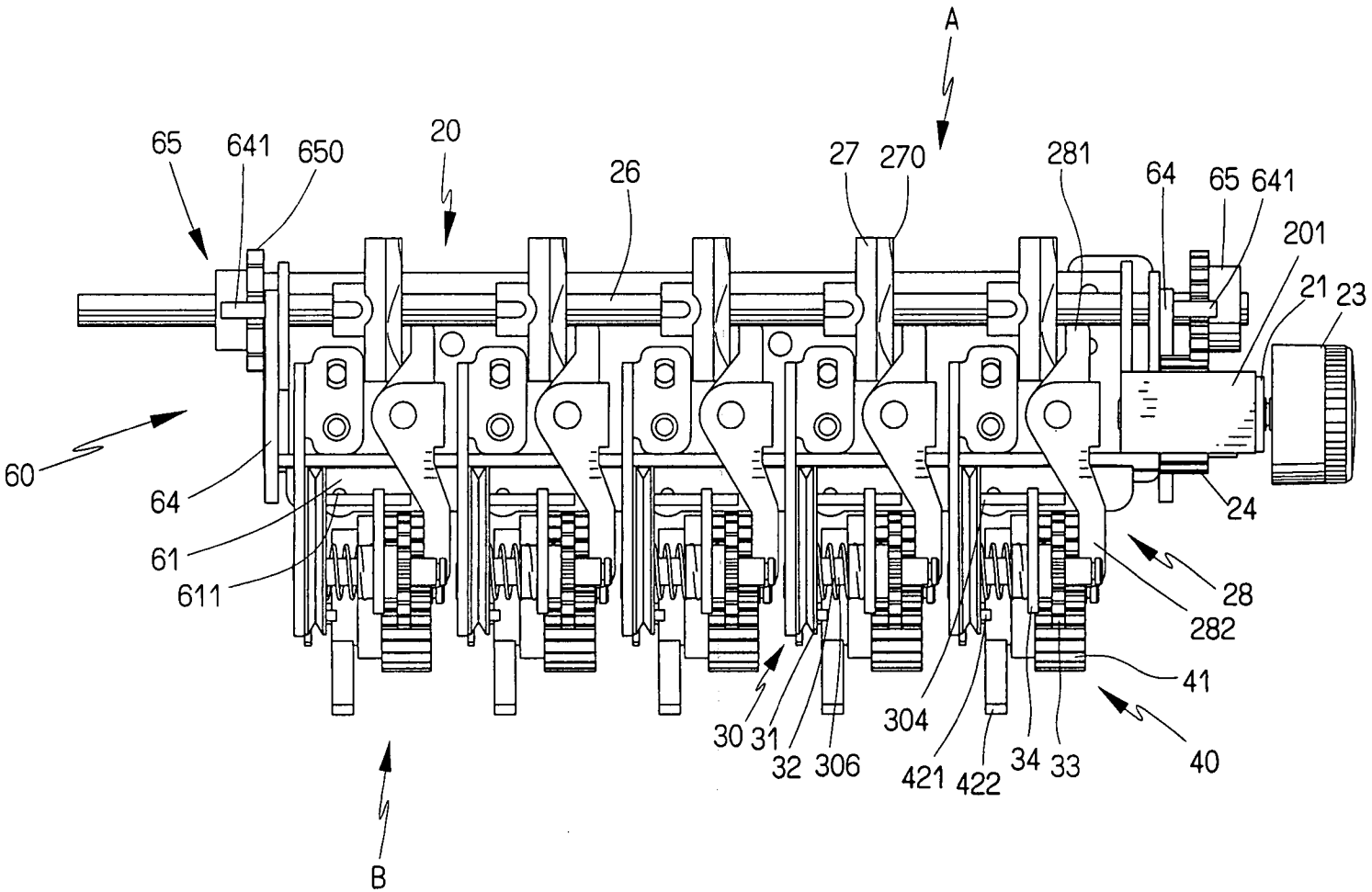
FIG. 7 shows a top view of another embodiment of the tension adjusting mechanism of the present invention.

As shown in FIG. 7, the extension portion 63, the restoring member 64 and the driving member 65 on one side of the main part 20 in the previous drawings can also be connected to two sides of the main part 20. Another restoring member 64 is installed to the restoring arm 62 as it was in the previous drawings such that the rod 641 is engaged with the driving member 65. The extension portion 63 is connected to the restoring disk 241 so that one end of the extension portion 63 is in contact with the restoring member 64, and the other end extends beyond the main part 20 and is in contact with the end piece 29. By this arrangement, the end piece 29 provides force to restore the extension portion 63.

Figure 8:
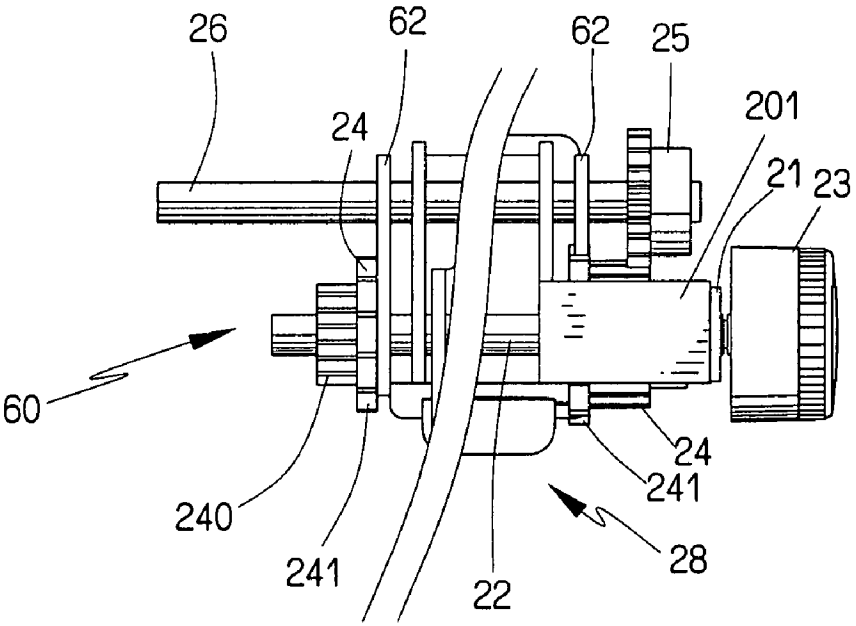
FIG. 8 shows a top view of yet another embodiment of the tension adjusting mechanism of the present invention.

As shown in FIG. 8, the restoring arms 62 can also be installed to two sides of the main part 20, one of the restoring arms 62 is connected to the restoring member 64 as described before and the second control shaft 22 extends through two ends of the main part 20. The active member 24 is then removed from the control shaft 26 and pivotably connected to the second control shaft 22. The rod 620 is engaged with the restoring disk 241 of the active member 24.

The present invention provides a restoring arm 62 at one end of the main part 20 and the other end of the main part 20 is connected with the extension portion 63, restoring member 64 and driving member 65, or the extension portion 63, restoring member 64 and driving member 65 are connected to each of the two ends of the main part 20, or the active wheel 24 and the restoring arm 62 are connected to the each of the two ends of the main part 20. Either of the arrangements is able to activate two sides of the pressing board 61 and move the pressing board 61 horizontally so that the restoring force is even.

While we have shown and described the embodiment in accordance with the present invention, it should be clear to those skilled in the art that further embodiments may be made without departing from the scope of the present invention.

What is claimed is:

1. A restoring device of a tension adjusting device (A) in a transverse arm (12) for a sewing machine (10), the tension adjusting device (A) comprising a main part (20) with a plurality of tension adjusting frames (30), micro-adjusting sets (40) and restoring sets (50) connected thereto so as to form a tension adjusting mechanism (B), the restoring sets (50) being controlled by a control set (60) on the main part (20), the main part (20) having an active member (24) which is driven by an adjusting knob (23) and the active member (24) driving a control shaft (26) on the main part (20), the control set (60) having a pressing board (61) which is pivotably connected to the main part (20) so as to press and control the restoring set (50), the control shaft (26) having a driving member (65) connected thereto and the pressing board (61) being driven by the active member (24) and the driving member (65).

2. The device as claimed in claim 1, wherein the pressing board (61) has a restoring arm (62) at a first end thereof and an end of the restoring arm (62) is pivotably connected to the main part (20) and engaged with the active member (24).

3. The device as claimed in claim 1, wherein an extension portion (63) extends from a second end of the pressing board (61) and is pivotably connected to the main part (20), an end of the extension portion (63) connected to an end of a restoring member (64) and the other end of the restoring member (64) being pivotably connected to the main part (20) and connected to the driving member (65).

4. A restoring device of a tension adjusting device (A) in a transverse arm (12) for a sewing machine (10), the tension adjusting device (A) comprising a main part (20) with a plurality of tension adjusting frames (30), micro-adjusting sets (40) and restoring sets (50) connected thereto so as to form a tension adjusting mechanism (B), the restoring sets (50) being controlled by a control set (60) on the main part (20), the main part (20) having a bracket (201) at one end thereof and a second control shaft (22) extending through the bracket (201), an active member (24) mounted to the second control shaft (22) and extending beyond the transverse arm (12) so as to be connected to a control shaft (26), at least one control wheel (27) mounted to the control shaft (26) and having travel control portions (270), a passive member (25) connected to an end of the control shaft (26) that extends through the bracket (201), at least one pin (203) connected to the main part (20) and a control arm (28) mounted to the at least one pin (203), the tension adjusting mechanism (B) having threaded holes (25) and positioning rods (206), both of which are located beside the at least one pin (203);

a tension adjusting frame (30) having a main shaft (303), a stop pin (304) and a micro-adjusting shaft (306) which is connected to a micro-adjusting set (40), a tension plate (31), a spring (32), an end plate (34) and an adjusting gear (33) respectively mounted to the main shaft (303), a hole (305) defined through the tension adjusting frame (30);

the micro-adjusting set (40) having a micro-adjusting member (41) which is engaged with the adjusting gear (33), the micro-adjusting member (41) having a correction member (42) at a center thereof and the correction member (42) having correction rods (422) and restoring rod (421);

the restoring set (50) having a restoring active pawl (51) and a restoring passive pawl (52) which is engaged with the restoring active pawl (51), each of the restoring active pawl (51) and the restoring passive pawl (52) having a restoring end (512/522), the restoring active pawl (51) having an action end (513) which is located opposite to a pressing board (61) of a control set (60);

the control set (60) having the pressing board (61) to which a restoring arm (62) and an extension portion (63) are connected to two ends of the pressing board (61), two respective free ends of the restoring arm (62) and the extension portion (63) connected to the control shaft (26), a restoring member (64) located above the extension portion (63);

the control shaft (26) having an end which extends through the main part (20) and a driving member (65) connected to the end of the control shaft (26);

the main part (20) having an end piece (29) which is in contact with the restoring arm (62), and the extension portion (63) having an end being in contact with an end of the restoring member (64), the other end of the restoring member (64) having a rod (641) and the restoring arm (62) having a rod (620) so as to be engaged with the driving member (65).

5. The device as claimed in claim 1, wherein an active wheel (240) is connected to the active member (24) and engaged with the passive wheel (250) of the passive member (25), a restoring disk (241) is connected to an outer periphery of the active member (24).

6. The device as claimed in claim 1, wherein a passive wheel (250) is connected to the passive member (25) and engaged with the active member (24), the passive wheel (250) engaged with the rod (620) on the restoring arm (62) and the rod (641) on the restoring member (64).

7. The device as claimed in claim 1, wherein the control arm (28) includes a contact end (282) at one end thereof and the other end of the control arm (28) has a pushing end (281), the contact end (282) is located close to the tension adjusting frame (30 and the pushing end (281) is engaged with the travel control portion (270) of the control wheel (27).

8. The device as claimed in claim 1, wherein the pressing board (61) has an adjusting hole (610) defined therethrough which is located corresponding to the action end (513) of the restoring active pawl (51) so that an adjusting bolt (611) extends through the adjusting hole (610) and contacts the action end (513).

9. The device as claimed in claim 1, wherein the extension portion (63) of the control set (60) includes a pushing end (630) extending from the end connected to the pressing board (61).

10. The device as claimed in claim 1, wherein the restoring member (64) of the control set (60) is pivotably connected to a side of the main part (20) and includes a function end (640) which is in contact with the extension portion (63) and a rod (641) which is engaged with the passive member (25).

* * * * *